United States Patent [19]

Maeda et al.

[11] Patent Number: 4,993,219

[45] Date of Patent: Feb. 19, 1991

[54] FALSE TWIST PROCESSING APPARATUS

[75] Inventors: Yoshiyasu Maeda, Yamatokooriyama; Toshiyuki Uno, Kusatsu; Yoshikazu Tanaka, Kyoto, all of Japan

[73] Assignee: Murata Kikai Kabushiki Kaisha, Kyoto, Japan

[21] Appl. No.: 309,411

[22] Filed: Feb. 9, 1989

[30] Foreign Application Priority Data

Feb. 13, 1988 [JP] Japan ..... 63-31259

[51] Int. Cl.[5] ..... D02G 1/02

[52] U.S. Cl. ..... 57/291; 57/284; 248/562; 267/141

[58] Field of Search ..... 57/291, 284; 248/562; 267/136, 141

[56] References Cited

U.S. PATENT DOCUMENTS

| | | | |
|---|---|---|---|
| 1,691,723 | 11/1928 | Keys | 267/141 X |
| 1,778,503 | 10/1930 | Lord | 267/136 X |
| 2,268,306 | 12/1941 | Sarti | 267/141 |
| 2,726,081 | 12/1955 | Hunter | 267/141 X |
| 2,872,774 | 2/1959 | Fink | 267/141 X |
| 3,367,096 | 2/1968 | Comer et al. | 57/291 |
| 4,031,690 | 6/1977 | Thomas et al. | 57/291 X |
| 4,308,716 | 1/1982 | Bauer | 57/291 X |
| 4,332,132 | 6/1982 | Bru et al. | 57/291 X |
| 4,809,494 | 3/1989 | Dammann | 57/291 |

*Primary Examiner*—Stuart S. Levy
*Assistant Examiner*—Steven M. duBois
*Attorney, Agent, or Firm*—Spensley Horn Jubas & Lubitz

[57] ABSTRACT

A false twist processing apparatus for applying a predetermined processing to chemical fiber filament yarns supplied from a yarn supply device by passing it through treating devices such as a yarn feed device provided on a frame, a heater, a false twisting member, a take-up device, and the like, wherein the frame is composed of at least two support columns which are independent from each other and stood upright on a floor surface, and the treating devices are mounted on the support columns so that a yarn processing route is formed between the two support columns.

13 Claims, 2 Drawing Sheets

FALSE TWIST PROCESSING APPARATUS

FIELD OF THE INVENTION

This invention relates a false twist processing apparatus principally for chemical fiber filament yarns.

RELATED ART STATEMENT

There has been known an apparatus for applying a predetermined false twisting process to a yarn supplied from a yarn supply device by passing the yarn through a plurality of yarn treating devices provided on a frame sideway of said yarn supply device (For example, Japanese Utility Model Application Laid-Open No. 21084/1987).

In the above-described yarn treating devices for the false twist processing apparatus, a heater, a cooling plate, a false twisting member (a false twisting spindle) and a take-up device are provided in order of processing steps, and as the case may be, a second heater for removing torque is provided between the false twisting member and the take-up device.

Since the aforesaid second heater is for removing torque, and therefore, a long heater is not required, but a heater (a first heater) arranged at upstream of the false twisting member need be relatively long. The reason why is that in the case where the yarn speed is increased in an attempt of increasing the processing speed of the yarn, the length of the heater need be extended to increase contact time between the yarn and the heater in order to apply sufficient heating to the yarn. In the aforesaid heater, smoke generated during processing is discharged along the heating surface thereof, and therefore, normally, the heater is supported vertically or with a suitable inclination. However, this increases a mounting height (a height of center of gravity) of the heater in line with an increased length of the heater itself.

On the other hand, those which are driven at high speeds and comprise a vibrating source among the aforementioned yarn treating devices are mainly the false twisting member (spindle for the false twisting member) and the take-up device.

The take-up device is normally provided at a relatively low position on a floor because an operator himself need to doff the wound package, and the spindle for the false twisting member is often provided thereabove.

Accordingly, a mechanical vibration induced by the vibration of the take-up device itself in the vicinity of a low position on the floor on which the take-up device is installed comprises no significant problem but a vibration of the spindle and a vibration induced by the transmission of the vibration of take-up device in the vicinity of the heater mounted at a relatively high level tend to be amplified. The amplified vibration induces a looseness in a fastening portion of bolts and nuts or the like during a long time of service, resulting in an unexpected trouble, and in an occurrence of trouble in processing of yarn.

OBJECT AND SUMMARY OF THE INVENTION

It is an object of the present invention to provide a false twist processing apparatus whereby transmission of vibrations induced by a false twisting member and a take-up device toward a heater can be minimized.

According to an embodiment of the present invention, there is provided a false twist processing apparatus for applying a predetermined processing to a yarn supplied from a yarn supply device by passing it through treating devices such as a yarn feed device provided on a frame, a heater, a twist member, a take-up device, and the like, wherein said frame is composed of at least two support columns which are independent from each other and stood upright on a floor surface, said treating devices are mounted on said support columns so that a yarn processing route is formed between said two support columns, and said heater is so mounted on the support column as transmission of vibrations of the support column, on which the false twisting member and the take-up device are mounted, toward the heater is minimized.

DETAILED DESCRIPTION OF PREFERRED EMBODIMENTS

Figure 1:
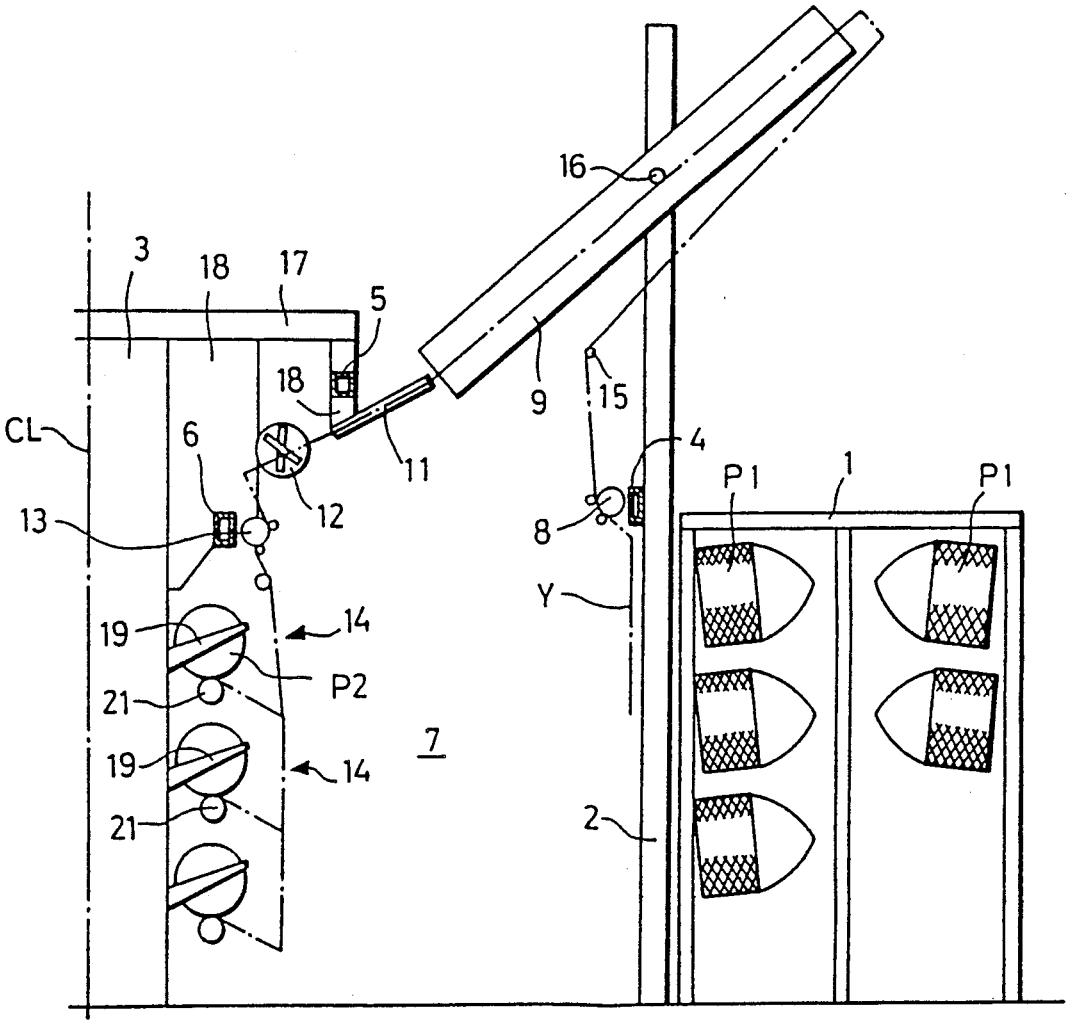
FIG. 1 is a side view of a twist processing apparatus according to a first embodiment of this invention.

FIG. 1 is a side view of a false twist processing apparatus as a first embodiment, showing a right half portion thereof, the whole being symmetrical to left and right with a center line indicated at dottedcontour lines (CL). A description will be made of the right half portion alone.

Reference numeral 1 designates a known creel which is a yarn supply device for supporting a number of yarn supply packages P1. Yarns drawn from the yarn supply packages P1 are gathered leftward of the creel through a guide pipe not shown and then introduced into treating devices which will be mentioned hereinbelow.

A first support column 2 is stood upright on the floor in close proximity of the creel 1, and a second support column 3 is stood upright on the floor apart therefrom. Accordingly, since this apparatus is symmetrical to left and right, the structure is that as viewed from the side, one support column 3 is stood upright, and two support columns 2 and 3 are stood upright to left and right, and the creel 1 is arranged externally thereof. The frame is constituted by the aforesaid support columns 2 and 3.

The above-described explanation was made by way of a side view. Actually, a suitable number of support columns 2 and 3 corresponding to the length of the machine bed are stood upright as viewed in front.

Reference numerals 4, 5 and 6 denote horizontal beams disposed over the full length of the machine bed as viewed from front.

There is a passage space 7 for an operator between the support columns 2 and 3 having a width so that a person may pass therethrough.

The treating devices are mounted in the following order so that a yarn may be extended between two support columns 2 and 3.

That is, the first support column 2 has a first feed roller 8 and a heater 9 mounted thereon, and the second support column 3 has a cooling plate 11, a belt type twist device 12 as a twist member, a second feed roller 13 and a take-up device 14 mounted thereon. 15 is a yarn guide. These devices will be described hereinafter.

The heater 9 is secured at 16, substantially at a position of center of gravity, to the upper portion of the first support column 2, and the cooling plate 11 is secured through a bracket 18 to the end of a horizontal beam 17 horizontally extended from the upper portion of the second support column 3. No connecting means is present between the lower end of the heater 9 and the cooling plate 11, which are completely separated.

A belt type false twisting device 12 is mounted at a front position of a reinforcing plate 18 extended sideway from the second support column 3, which is a well known construction. The second feed roller 13 is mounted on the horizontal beam 6. The take-up device 14 is composed of cradles 19 for supporting packages P2, friction rollers 21 and traverse devices not shown, as well known.

In the false twist processing apparatus according to this embodiment, a yarn Y from the creel 1 is subjected to false twist processing passing through said devices in said order and wound as a package P2 on the take-up device 14. Vibrations when the take-up device 14 and the false twisting member 12 are operated are not transmitted to the first support column 2, that is, to the heater 9.

Next, the second embodiment will be described with reference to FIG. 2.

Figure 2:
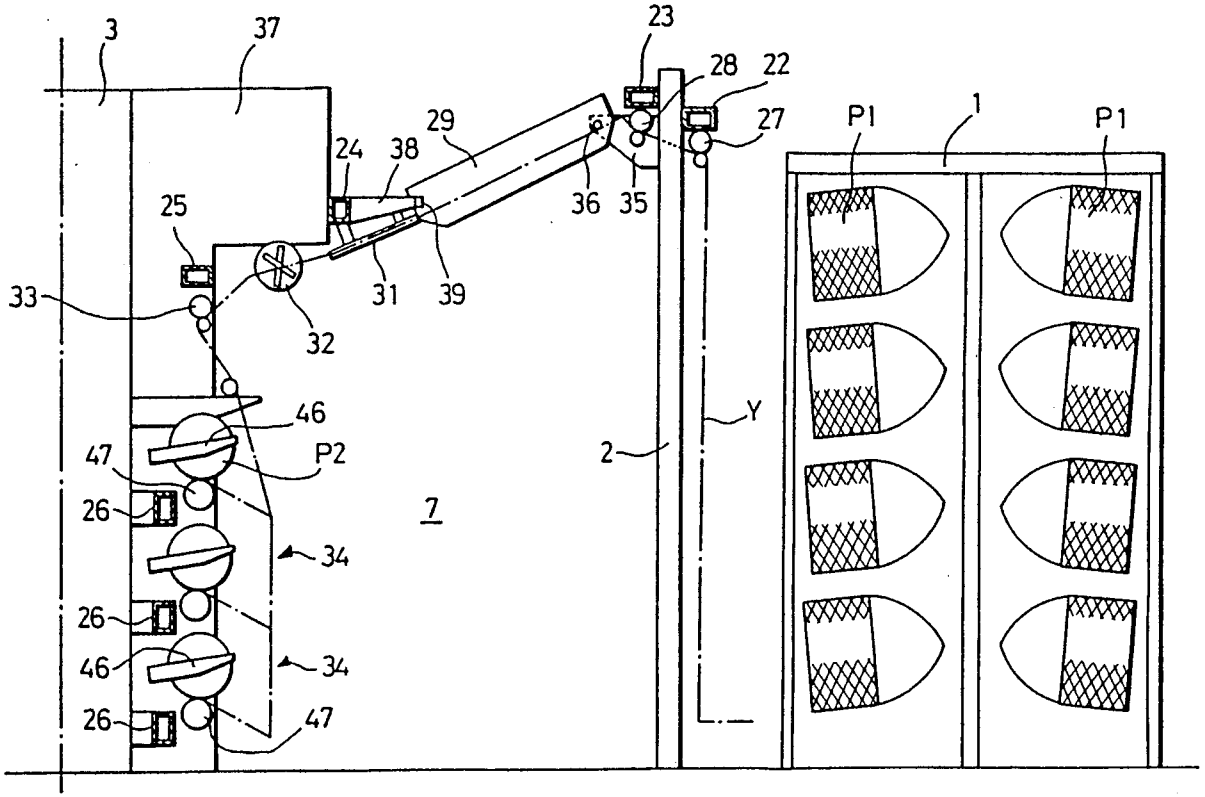
FIG. 2 is a side view of a second embodiment thereof.

In FIG. 2, the creel 1, the first and second support columns 2 and 3 are arranged in the same manner as that of the first embodiment, and a passage space 7 for an operator is likewise formed between the support columns 2 and 3.

Horizontal beams are indicated at 22, 23, 24, 25 and 26.

In the second embodiment, the treating devices are mounted as described below so that a yarn is extended between the two support columns 2 and 3.

That is, the first support column 2 has first and second feed rollers 27, 28 and one end of a heater 29 mounted thereon, and the second support columns 3 has a cooling plate 31, a belt type false twisting device 32 as a false twisting member, a third feed roller 33 and a take-up device 34.

These devices will be described hereinafter.

The first and second feed rollers 27 and 28 are mounted on the horizontal beams 22 and 23, and the heater 29 is pivoted at 36 at one end thereof on a bracket 35 extended from the first support column 2 while the other end being free with respect to the first support column 2.

The cooling plate 31 is fixedly suspended from a support bracket 38 secured to the front surface of a reinforcing plate 37 horizontally extended from the upper portion of the second support column 3. The end of the cooling plate 31 and the lower end of the heater 29 are not connected but the lower end of the heater 29 is connected to the end of the support bracket 38 through a damper device 39 so as to be discontinuous with relative to vibrations.

Figure 3:
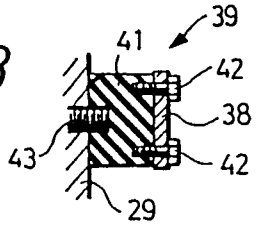

That is, as shown in FIG. 3, a hard rubber member 41 is bolted at 42 to the end of the support bracket 38, and the other end of the rubber member 41 is secured to a bolt 43 projected from the heater 29. Accordingly, approximately half the weight of the heater 29 is supported by the hard rubber member 41 of the damper device 39.

Preferably, the hard rubber member 41 is preferably selected to have properties which absorb the number of vibrations generated particularly on the side of the take-up device 34 and false twisting member 32.

Figure 4:
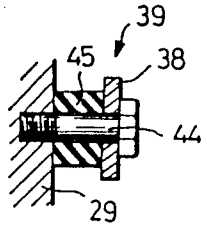
FIGS. 3 and 4 are respectively sectional views showing a damper device.

Furthermore, the damper device 39 may be constituted by a bolt 44 screwed into the heater 29 extending through the end of the support bracket 38 and an annular rubber member 45 inserted into the bolt 44, as shown in FIG. 4. In this case, the stability of supporting the heater 29 is enhanced, and this arrangement is suitable for the case of supporting the heater 29 having a relatively large weight.

The supporting position 36 of the heater 29 to the bracket 35 may be of approximately the position of center of gravity as in the first embodiment. In this case, a resilient member such as a spring, an air cushion or the like can be used in place of the rubber member 41 of the damper device 39.

The belt type false twisting device 32 is secured to the lower surface of the reinforcing plate 37, and the take-up device 34 is composed of cradles 46 for supporting packages P2, friction rollers 47 and traverse devices not shown, as is well known.

Also, in the false twist processing apparatus according to the second embodiment, similarly to the first embodiment a yarn Y from the creel 1 is subjected to false twist processing in the aforesaid order and wound as a package P2 on the take-up device 34. Vibrations when the take-up device 34 and twist member 32 are operated are shut off by the damper device 39 and not transmitted to the first support column 2, that is, the heater 29.

As described above, in the false twist processing apparatus according to the present invention, the transmission of vibrations toward the heater in which vibrations tend to be amplified can be minimized. Therefore, an unexpected trouble resulting from a looseness of a fastening portion or the like can be avoided, and an occurrence of trouble in processing yarns caused by the vibrations can also be avoided.

What is claimed is:

1. In a yarn processing apparatus having a false twisting device, a heater provided with a yarn passage and an entrance to the yarn passage which is substantially linearly aligned with the false twisting device, and a yearn take-up device, the improvement comprising support structure for supporting the heater and at least one of the false twisting device and the yarn take-up device, to minimize the transmission toward the heater of vibrations produced by the operation of the false twisting device or the yarn take-up device, the support structure comprising:

first support means for supporting the false twisting device, the first support means being inherently vibratory upon operation of at least one of the false twisting device and the yarn take-up device; and second support means for supporting the heater in substantial isolation of the vibrations of the first support means;

wherein the transmission of vibrations produced by the operation of the false twisting device or the yarn take-up device, toward the heater, is minimized; and wherein one end of said heater is supported by the second support means and another end of said heater is supported through a damper device to a support bracket connected to the first support means.

2. The false twist processing apparatus as claimed in claim 1, wherein said heater is secured substantially at a position of center of gravity to the upper portion of the first support column.

3. The false twist processing apparatus as claimed in claim 1, further comprising a cooling plate supported by a bracket connected with the second support column, the cooling plate being provided between the false twisting device and the heater, wherein a lower end of the heater and an end of the cooling plate are arranged end-to-end and spaced apart with respect to each other.

4. The false twist processing apparatus as claimed in claim 1, wherein one end of the heater is pivotally supported by a pivotal bracket fixed to the second support means.

5. The false twist processing apparatus as claimed in claim 1, wherein said damper device comprises a hard rubber member which is bolted to the end of the support bracket at one end thereof and is secured to a bolt projected from the heater at another end thereof.

6. The false twist processing apparatus as claimed in claim 5, wherein said hard rubber member is composed of a material selected to have properties which absorb vibrations generated on the side of the take-up device and false twisting member.

7. The false twist processing apparatus as claimed in claim 1, wherein said damper device is constituted by a bolt screwed into the heater extending through the end of the support bracket and a rubber member inserted into the bolt.

8. Apparatus as claimed in claim 1, wherein:

the second support means includes means for supporting the heater in an inclination; and the lower end of the inclined heater is directed toward the false twisting device.

9. Apparatus as claimed in claim 1, wherein the second support means comprises a first support column and the first support means comprises a second support column.

10. Apparatus as claimed in claim 9, wherein said first and second support columns are spaced apart from each other and structurally disconnected from each other.

11. Apparatus as claimed in claim 9, wherein said first and second support columns comprise first and second column members, respectively, arranged upright on a floor surface.

12. Apparatus as claimed in claim 9, wherein the first support column is spaced from and structurally disconnected from the second support column and any structure supported by the second support column.

13. In a yarn processing apparatus having a false twisting device, a heater provided with a yarn passage and an entrance to the yarn passage which is substantially linearly aligned with the false twisting device, and a yearn take-up device, the improvement comprising support structure for supporting the heater and at least one of the false twisting device and the yarn take-up device, to minimize the transmission toward the heater of vibrations produced by the operation of the false twisting device or the yarn take-up device, the support structure comprising:

first support means for supporting the false twisting device, the first support means being inherently vibratory upon operation of at least one of the false twisting device and the yarn take-up device; and second support means for supporting the heater in substantial isolation of the vibrations of the first support means;

wherein the transmission of vibrations produced by the operation of the false twisting device or the yarn take-up device, toward the heater, is minimized; and wherein said heater is pivotally supported by the second support means substantially at the center of gravity and a lower end of said heater is connected through a resilient member to a support bracket connected to the first support means which supports a cooling plate, the false twisting device and the take-up device.

* * * * *